US010290386B2

(12) United States Patent
Xiao et al.

(10) Patent No.: US 10,290,386 B2
(45) Date of Patent: May 14, 2019

(54) HIGHLY CONDUCTIVE POROUS PAPER-BASED METAL THIN FILMS

(71) Applicants: Yi Xiao, Miami, FL (US); Bhargav Guntupalli, Miami, FL (US); Janak Paudyal, Miami, FL (US)

(72) Inventors: Yi Xiao, Miami, FL (US); Bhargav Guntupalli, Miami, FL (US); Janak Paudyal, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 192 days.

(21) Appl. No.: 15/146,440

(22) Filed: May 4, 2016

(65) Prior Publication Data

US 2016/0329121 A1 Nov. 10, 2016

Related U.S. Application Data

(60) Provisional application No. 62/156,594, filed on May 4, 2015.

(51) Int. Cl.
*H01B 1/02* (2006.01)
*H01B 1/04* (2006.01)

(52) U.S. Cl.
CPC ..... *H01B 1/04* (2013.01); *H01B 1/02* (2013.01)

(58) Field of Classification Search
CPC ..... H01B 1/04; H01B 1/02
See application file for complete search history.

(56) References Cited

U.S. PATENT DOCUMENTS 6,936,233 B2 8/2005 Smalley et al.
2013/0251943 A1* 9/2013 Pei ..... H01B 1/02 428/141

OTHER PUBLICATIONS

Choi, H.C. et al., "Spontaneous Reduction of Metal Ions on the Sidewalls of Carbon Nanotubes," *J. Am. Chem. Soc.*, 2002, pp. 9058-9059, vol. 124.
Eder, D. "Carbon Nanotube—Inorganic Hybrids,", *Chem. Rev.*, 2010, pp. 1348-1385, vol. 110.
Gingery, D. et al., "Formation of gold nanoparticles on multiwalled carbon nanotubes by thermal evaporation," *Carbon*, 2008, pp. 1966-1972, vol. 46.
Henley, S.J. et al., "Laser-induced decoration of carbon nanotubes with metal nanoparticles," *Applied Physics A*, 2008, pp. 875-879, vol. 93.
Hsu, M-H. et al., "Simple and highly efficient direct thiolation of the surface of carbon nanotubes," *RSC Adv.*, 2014, pp. 14777-14780, vol. 4.

(Continued)

*Primary Examiner* — Victor S Chang
(74) *Attorney, Agent, or Firm* — Saliwanchik, Lloyd & Eisenschenk

(57) ABSTRACT

A porous conductive thin film includes a layer of metal nanoparticles decorated on a layer of conductive carbon nanomaterials. The thin film can be supported by a porous support. The porous support can be a MCE paper upon which a metallic or semi-metallic single-walled carbon nanotube (SWCNT) layer is decorated with gold nanoparticles (AuNPs) or platinum nanoparticles (PtNPs). The thin film can be constructed by filtering a dispersion of SWCNTs onto MCE filter paper followed by the filtration of a citrate stabilized dispersion of AuNPs or PtNPs onto the SWCNT layer.

17 Claims, 8 Drawing Sheets

(56) References Cited

OTHER PUBLICATIONS

Kim, J.Y. et al., "Enhanced Durability of Linker-Containing Carbon Nanotube Functionalized via Diazonium Reaction," *Electrochimica Acta*, 2015, pp. 63-69, vol. 154.
Lascialfari, L. et al., "Carbon nanotubes/laser ablation gold nanoparticles composites," *Thin Solid Films*, 2014, pp. 93-99, vol. 569.
Lin, G-L. et al., "Active and stable platinium/ionic liquid/carbon nanotube electrocatalysts for oxidataion of methanol," *ScienceOpen Research*, 2014, pp. 1-8.
Qu, L. et al., "Substrate-Enhanced Electroless Deposition of Metal Nanoparticles on Carbon Nanotubes," *J. Am. Chem. Soc.*, 2005, pp. 10806-10807, vol. 127.
Quinn, B.M. et al., "Electrodeposition of Noble Metal Nanoparticles on Carbon Nanotubes," *J. Am. Chem. Soc.*, 2005, pp. 6146-6147, vol. 127.
Siqueira, J.R.,Jr., et al., "Electrodeposition of catalytic and magnetic gold nanoparticles on dendrimer-carbon nanotube layer-by-layer films," *Phys. Chem. Chem. Phys.*, 2012, pp. 14340-14343, vol. 14.
Soin, N. et al., "Sputter deposition of highly dispersed platinum nanoparticles on carbon nanotube arrays for fuel cell electrode material," *Diamond & Related Materials*, 2010, pp. 595-598, vol. 19.
Star, A. et al., "Gas Sensor Array Based on Metal-Decorated Carbon Nanotubes," *J. Phys. Chem. B*, 2006, pp. 21014-21020, vol. 110.
Voggu, R. et al., "Semiconductor to metal transition in SWNTs caused by interaction with gold and platinum nanoparticles," *J. Phys.: Condens. Matter*, 2008, p. 215211 (5 pp), vol. 20.
Wu, Z. et al., "Transparent, Conductive Carbon Nanotube Films," *Science*, Aug. 27, 2004, pp. 1273-1276, vol. 305.
Zhang, R. et al., "Porous Gold Films—A Short Review on Recent Progress," *Materials*, 2014, pp. 3834-3854, vol. 7.
Zeng, Z. et al., Electrochemical deposition of Pt nanoparticles on carbon nanotube patterns for glucose detection, *Analyst*, 2010, pp. 1726-1730, vol. 135.
Compton, O.C., et al., "Evolution of Size and Shape in the Colloidal Crystallization of Gold Nanoparticles," *J. Am. Chem. Soc.*, 2007, pp. 7793-7798, vol. 129.
Liu, Y. et al., "A new method for fabricating ultrathin metal films as scratch-resistant flexible transparent electrodes," *Journal of Materiomics*, 2015, pp. 52-59, vol. 1.

* cited by examiner

HIGHLY CONDUCTIVE POROUS PAPER-BASED METAL THIN FILMS

CROSS-REFERENCE TO A RELATED APPLICATION

This application claims the benefit of U.S. Provisional Application Ser. No. 62/156,594, filed May 4, 2015, the disclosure of which is hereby incorporated by reference in its entirety, including all figures, tables and drawings.

BACKGROUND OF INVENTION

Porous metals are useful because they are catalytically active and highly electrically conductive. Porous metal films are useful in, for example, transistors, solar cells, and electrochemical sensors. Among the metallic porous films, gold films are chemically stable and have a unique surface chemistry. Porous gold films have the unique properties of high specific surface area and electrical conductivity combined with chemical stability and ability to alter the surface chemistry. Several methods have been developed to prepare porous gold films, such as, de-alloying, templating, electrochemical, and self-assembling. Rigid template-directed methods for forming porous gold films typically achieve a uniform pore-size distribution, but the electrocatalytic and sensing performance of such films is insufficient due to limited porosity. Furthermore, post-dissolution of the rigid template during production is very time-consuming. There is a need for a simple, economical and environmentally-friendly approach to effectively prepare three-dimensional porous gold films with high surface area-to-volume ratios, high conductivity, and good mechanical properties.

A potential method is by the deposition of nanoparticles (NPs) on the surface of carbon nanotubes. The most widely studied approaches include: electrodeposition (ED) (for example, Zeng et al. *Analyst,* 2010, 135, 1726-30 and Siqueira, Jr. et al. *Phys. Chem. Chem. Phys.,* 2012, 14, 14340-43); electrolytic deposition (for example, Choi et al. *J. Am. Chem. Soc.,* 2002, 124 (31), 9058-59); electroless deposition (for example, Qu et al. *J. Am. Chem. Soc.,* 2005, 127 (31), 10806-7); and physical methods including sputtering (for example, Soin et al. *Diamond and Related Materials,* 2010, 19, (5-6), 595-8), thermal evaporation (for example, Gingery et al. *Carbon,* 2008, 46, (14), 1966-72), electron beam evaporation (for example, Star et al. *J. Phys. Chem. B,* 2006, 110 (42), 21014-20, Eder *Chem. Rev.,* 2010, 110 (3), 1348-85); and dispersion of NPs obtained with chemical methods onto functionalized CNTs (for example Hsu et al. *RSC Adv.,* 2014, 4, 14777-80).

DETAILED DISCLOSURE

Figure 1A:
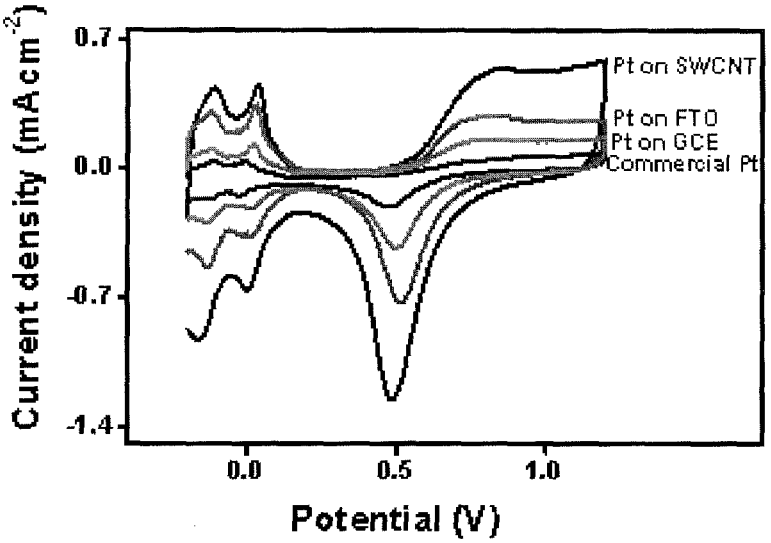
FIG. 1A shows cyclic voltammetry (CV) response plots of a commercial Pt electrode, Pt on a glassy carbon electrode (GCE), Pt on fluorine doped tin oxide (FTO), and a Pt-single walled carbon nanotubes (SWCNT), according to an embodiment of the invention, in 0.5 M $H_2SO_4$ at the scan rate of 50 mV $s^{-1}$.

Embodiments of the invention are directed to a porous conductive film comprising metal decorated metallic/semi-metallic/pure tube single-walled carbon nanotube (SWCNT) films or other metal decorated conductive carbon films. The porous conductive film can be situated on a supporting paper. These SWCNT films can be used as a conductive support for a metal nanoparticle (NP) assembly, for example, a gold nanoparticle (Au-NP) assembly or platinum nanoparticles (Pt-NP), which is constructed on a paper substrate. The paper substrate can be an MCE filter paper supporting the hybrid nanostructure because it is easy to use, biodegradable, combustible, and portable. In this manner, paper-based porous conducting films with excellent electrochemical properties can be formed. The device can be an electrocatalytic detector, an electrode, or any other porous conductive structure in a detector, transistor, or photovoltaic device.

In an embodiment of the invention, a simple, rapid and ambient vacuum filtration method generates the gold films without sophisticated instruments or a clean-room environment with no functionalization of the carbon for reception of the metal nanoparticles. The method of preparation requires two steps of filtration using two aqueous solutions. For example, a single-walled carbon nanotubes (SWCNT) film can be formed on a MCE filter paper in a first filtration of dispersed SWCNTs in water, followed by the filtration of citrate-coated gold nanoparticles (AuNPs) dispersed in 1% Triton X-100 or sodium dodecyl sulfate (SDS) solution. The conductive carbon material can be a doped material, such that the conductivity is greater than the undoped materials, and is often semiconducting in nature.

The SWCNT film is deposited in the manner that "bucky paper" is formed, as disclosed in Smalley et al. U.S. Pat. No. 6,936,233, to give a three dimensional network of nanotubes where nanotubes form a percolating network with pores. The SWCNT network can be very thin, as little as about 50 nm in thickness, where the film is almost transparent, as disclosed in Wu et al. *Science* 2004, 305, 1273-6. As such the SWCNT films display a sheet resistance of 30 ohm/square or less and a resistivity of $1.5\times10^{-4}$ ohm·cm or less. Alternately, the films can be of a surface density of about 5 to about 20 $\mu g/cm^2$, but displays the minimal sheet resistance when the surface density is at least 6.6 $\mu g/cm^2$. The surface roughness of the film is inversely related to the surface density, where, for example, roughness varies from, for example, 18.5% for a density of 2.2 $\mu g/cm^2$ to 4.47% for a density of 17.6 $\mu g/cm^2$.

The metal NPs are infused into the pores and onto the carbon surfaces while maintaining the three-dimensional nature of the nanotube network. For example, the SWCNTs form a network that has a diameter of about 1 nm and lengths up to many thousands of nanometers. The gold, platinum, or other metal nanoparticles can be about 2 nm to about 100 nm in size and can be spherical or rod shaped where the rods can have an aspect ratio of about 1.4 to about 18. The choice of nanoparticle sizes depends on the SWCNT film used or the filter upon which the film is fabricated. Single-walled carbon nanotubes (SWCNT) are suspended in surfactant via sonication. The film is prepared in three steps. In a first step, the dispersed SWCNTs form a uniform compact layer on a porous filter paper substrate by vacuum filtration (VF). In a second step, surfactant is washed from the SWCNT layer. In a third step, a second vacuum filtration of a dispersion of different sized metal NPs is performed, resulting in a reflective metal film on top of the SWCNT layer. Vacuum filtration forces the carbon nanotubes to lie flat on the paper's surface with maximum overlap, interpenetration, and minimal aggregation, yielding good electrical conductivity and mechanical integrity throughout the compact film. Rapid filtration of the metal NPs dispersion, by a vacuum filtration technique, forces an even deposition of the particles onto the surface of the nanotube layer rather than aggregated metal islands. The desired film thickness and its physical properties can be controlled by simply changing the volume or concentration of the nanomaterials.

In an embodiment of the invention, Au-SWCNT films are superior electrode materials for electrocatalytic detection, particularly relative to standard flat gold slides. The films generate a large oxidation current for electroactive molecules, for example, dopamine and serotonin, are capable of discriminating the simultaneous presence of both molecules in a manner that cannot be achieved with a bare flat gold slide. This procedure approach to porous metal electrodes permits a highly reproducible fabrication of various metal films at ambient conditions, and can be used as a film based device that can be transferred to other metal or flexible substrates.

Figure 1B:
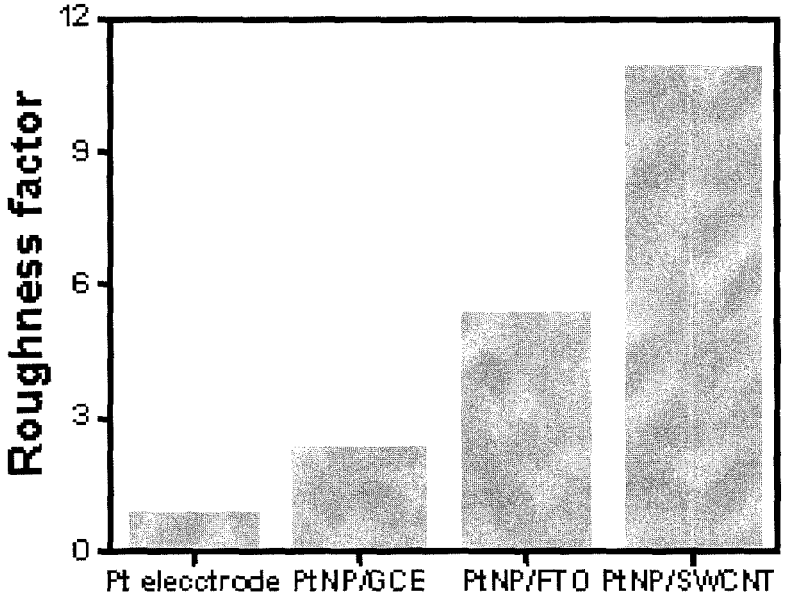
FIG. 1B shows a plot of the roughness factor calculated as the ratio of electrochemical surface area (ECSA) to geometric surface area for the commercial Pt electrode, Pt/GCE, Pt/FTO, and Pt-SWCNT, according to an embodiment of the invention.

In another embodiment of the invention, a paper based Pt-SWCNT composite thin film is formed. SWCNT thin films, by vacuum filtration on porous mixed cellulose ester membranes, are used to form electrode materials upon deposition of platinum. Cyclic voltammetry (CV) can be used to characterize the platinum loaded on the surface of electrodes by measuring Electrochemical Surface Area (ECSA). FIG. 1A represents cyclic voltammograms of platinum on different electrodes, where, for comparison, platinum deposited in traditional GCE and FTO electrode surfaces are used. ECSA is calculated by integrating hydrogen adsorption-desorption curve. ECSA of commercial platinum of 0.0308 $cm^{-2}$ was small relative to ECSA's of 0.1652, 0.4891, and 0.9516 $cm^{-2}$ for Pt on GCE, FTO, and SWCNT paper respectively. SWCNT paper is an efficient electrocatalytic support for Pt. A roughness factor, the ratio of ECSA to geometric surface area, as plotted in FIG. 1B, indicates that real surface area can be increased up by about 10.88 times on SWCNT paper than is possible on GCE, about 2.3 times, and FTO, about 5.4 times.

Figure 2A:
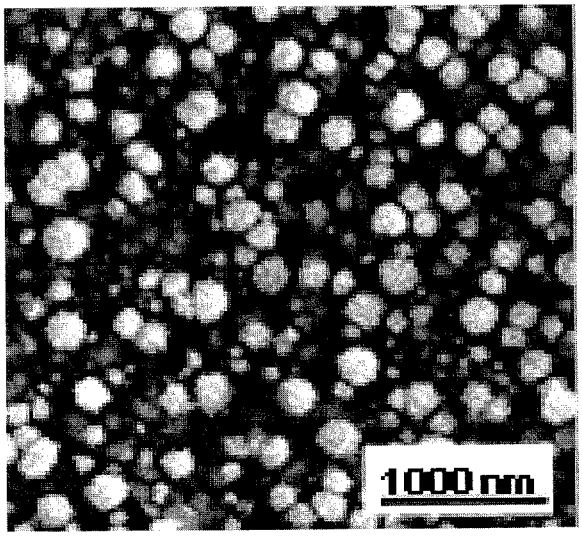
FIG. 2A is a field emission scanning electron microscopy (FE-SEM) image of Pt nanoclusters electrodeposited on SWCNT-loaded mixed cellulose ester (MCE) filter paper.
Figure 2B:
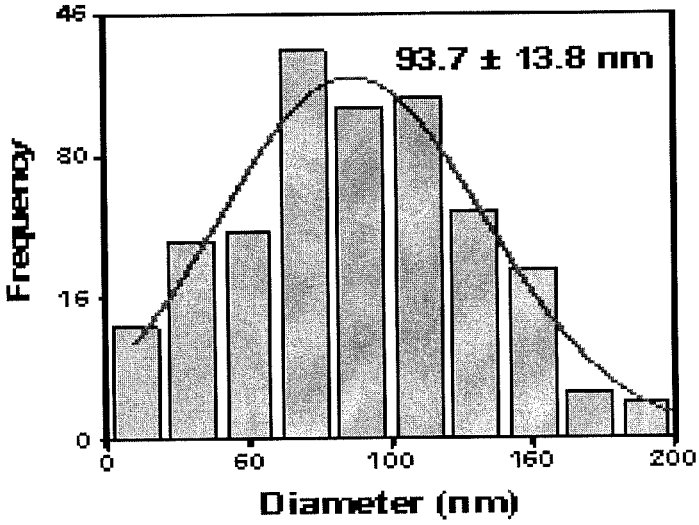
FIG. 2B is a plot of the size distribution of Pt nanoclusters electrodeposited on SWCNT-loaded MCE filter paper by analysis using imageJ software from SEM images.

Electro-deposition Pt-SWNT paper, as shown in FIG. 2A results in a surface that is decorated with clusters of platinum of, for example, the 93.7±13.8 nm clusters indicated in FIG. 2B, where the clusters displayed outer spike-like tips to form the appearance of nano-flowers. Due to the hydrophobic nature of SWCNT, adsorption of platinum salt on the surface of CNT is considered as a limiting factor for metal nanoparticle deposition on its surface. Therefore, nanoparticles formed during electro-deposition appear to form nucleation sites for particle growth to form complex nano-flower like structure. It has been reported that well dispersed metal particles are formed on the surface of functionalized CNT; however nanoclusters are formed on the surface of CNT containing very few or no functionalized groups.

Figure 2C:
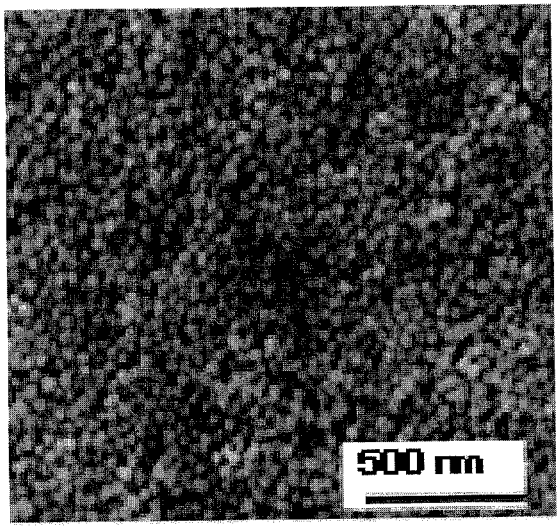
FIG. 2C is a FE-SEM image of Pt nanoclusters on SWCNT-loaded MCE filter paper via layer-by-layer deposition by vacuum filtration of 29 nm Pt nanoparticles on a SWCNT film, according to an embodiment of the invention.
Figure 2D:
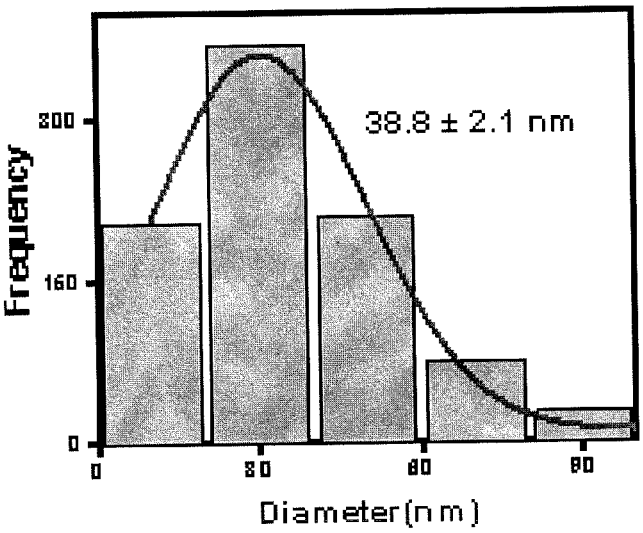
FIG. 2D is a plot of the size distribution of Pt nanoclusters on SWCNT-loaded MCE filter paper via layer-by-layer deposition, according to an embodiment of the invention by analysis using imageJ from SEM images.

In an embodiment of the invention, the Pt-SWCNT composite electrodes with a large surface area are formed by depositing platinum nanoparticles on SWCNT paper by vacuum filtration technique, as shown in FIG. 2C. Citrate capped Pt nanoparticles are physically trapped on porous SWCNT thin film due to the downward convective forces during vacuum filtration. For example, a VF formed Pt-SWCNT composite is a continuous network of platinum particles of three-dimensional nano-porous like structures on top of carbon nanotube film, where the average size particle by SEM is 38.8±2.1 from the deposition of 29 nm Pt-nanoparticles, as indicated in FIG. 2D.

Alternatively to the MCE filter paper, other filtration media can be used, including, but not limited to, other paper filters, packed particulate filters, porous plastic filters, and porous ceramic filters. For example, polyvinylidene fluoride (PVDF), polysulfone (PES), Polytetrafluoroethylene (PTFE), polycarbonate, and cellulose filters can be used. The paper can be removed if desired, to leave a free standing SWCNT-metal NP film. The MCE filter paper is available commercially with pore sizes of about 25 nm and greater.

Alternatively to the SWCNTs, other conductive carbon materials, such as, but not limited to, multi-walled carbon nanotubes and graphene flakes, can be used as a possible conductive underlay for the deposition of metal nanoparticles. In addition to gold, the metal nanoparticles can be of various types, including, but not limited to: silver; copper; platinum; palladium; any alloy thereof, or mixtures thereof. Metal mixtures can be in the form of a mixed layer of metal nanoparticles or can be in the form of alternating layers of metal films. The carbon materials can also be a mixture, and the layered structures can be of carbon-(metal-carbon)$_n$-metal where n is 0 to about 10. The alternating films can have different metals, different carbons, mixed metals, and mixed carbons. These hybrid films can be used in electrochemical catalysis or electro-optical devices, as well as in reflective, conductive or energy-collecting metallic coatings in a photovoltaic device.

The porous metal films can be readily prepared in a manner where the structure is easily designed and reproducibly achieved for a number of applications, including, but not limited to: electrochemical catalysis; electro-optical devices; or reflective, conductive, or energy-collecting metallic coatings. Paper-based electrodes can be used as on-site electrochemical detection platforms that achieve increased portability, flexibility, and reduced cost of production relative to existing systems.

Methods and Materials

Figure 3:
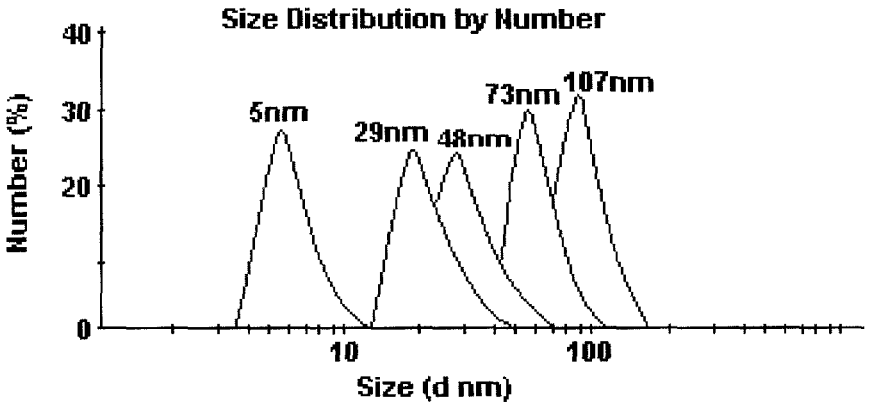
FIG. 3 shows plots of the size and size distribution by dynamic light scattering of the citrate capped Pt-NPs ranging from sizes 5 to 107 nm.

Citrate-capped platinum-NPs were synthesized by a multi-step seed mediated technique. Seeds were synthesized of 5 nm diameter and used to form nanoparticles of 29 nm, 48 nm, 73 nm and 107 nm. Seeds of 5 nm were formed where 3.6 ml of 0.2% solution of chloroplatinic acid hexahydrate was added to 46.4 ml boiling water. After 1 minute, 1.1 ml of solution containing 1% sodium citrate and 0.05% citric acid was added to the aqueous solution followed by rapid injection of 0.08% 0.55 ml freshly prepared sodium borohydrate containing 1% sodium citrate and 0.05% citric acid after 30 seconds. To prepare 29 nm Pt nanoparticles, 1 ml of platinum seeds were added to 29 ml of deionized water at room temperature; followed by sequential addition of 45 μl of 0.4M chloroplatinic acid solution and 0.5 ml of a 1% sodium citrate and 1.25% L-ascorbic acid solution. Under stirring, the temperature was slowly increased to boiling at about 10° C./min over a period of 30 minutes. The Pt-NPs were characterized using dynamic light scattering (DLS) measurements, showing a narrow size distribution for each of the Pt-NPs in addition to confirming the average diameter of the nanoparticles, as illustrated in FIG. 3.

Concentrated pure tube single-walled carbon nanotubes (SWCNT) from Nano Integris (Arc discharge method, 1.4 nm diameter, 1 micron length) were further diluted in 1% sodium dodecyl sulfate solution or 1% Triton X-100™ surfactant and dispersed using sonication (335 W, 50/60 Hz) for 10 minutes. The suspended SWCNTs (100 micrograms) (Millipore, 0.1 μm) was placed in the filtration apparatus, allowed to settle for a period of about 5 minutes, and filtered with a slow increase of vacuum over an hour to form a uniform compact layer on a mixed cellulose ester (MCE) paper substrate by vacuum filtration. The Triton X-100 was washed from the SWCNT layer with DI water.

To the SWCNT thin film remaining on the vacuum filtration apparatus was poured a Pt nanoparticles suspension. The suspension was of Pt nanoparticles that were washed three times by precipitation in a centrifuge at 7100 rpm for half an hour with the supernatant exchanged with equal an amount of DI water to re-disperse the particles. Vacuum was applied slowly to remove water. The resulting Pt-SWCNT thin film was dried overnight, resulting in a reflective Pt film on top of the SWCNT.

Total platinum on Pt-SWCNT paper was determined by ICP-MS. Pt-SWCNT paper was cut into equi-size electrodes and digested in 1 ml aqua-regia solution for 12 hours. To ensure complete extraction of Pt from the SWCNT paper, two digestions for an additional three hours in two fresh 1 ml aqua-regia solutions was performed. Sample was further diluted in 2% nitric acid and total Pt was determined using a calibration curve of standard solutions of Pt using internal standard method.

Figure 4A:
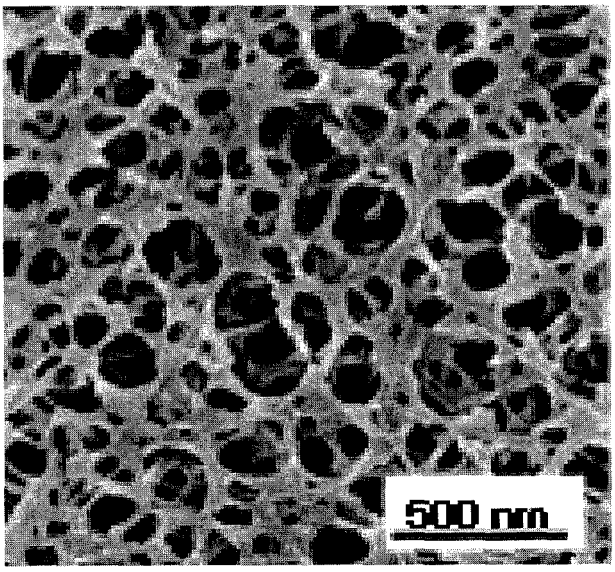
FIG. 4A is a FE-SEM image of MCE filter paper.
Figure 4B:
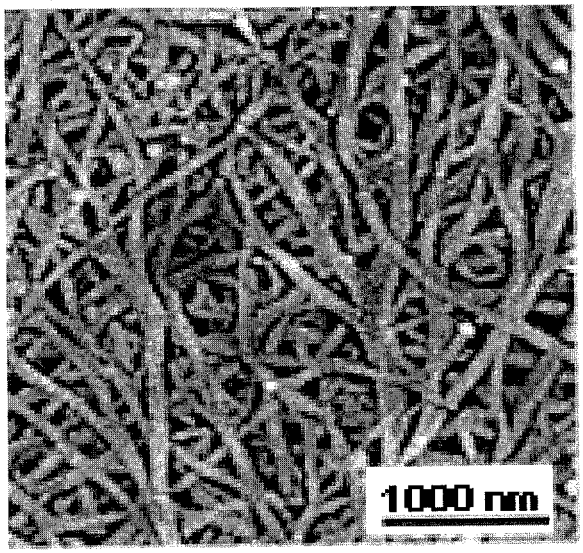
FIG. 4B is a FE-SEM image of SWCNT-loaded MCE filter paper.

Field emission scanning electron microscope (FE-SEM) images were obtained on an S-4800 microanalyzer (Hitachi, Japan) XPS: X-ray photoelectron spectroscopy (XPS) and an ESCALAB 250 spectrometer equipped with a monochromatic Al Kα X-ray source (Thermo Fisher Scientific Inc., U.K.) XRD: X-ray diffraction (XRD) measurement was performed on a D/MAX 2200 VPC diffractometer using Cu Kα radiation (λ=0.154056 nm) with a Ni filter (Rigaku, Japan). FIGS. 4A and 4B show FESEM images of MCE membrane and SWCNT loaded MCE paper, respectively. FIGS. 2A and 2C show FESEM images of platinum decorated PSWCNT paper by ED and VF method, respectively.

All the electrochemical experiments were carried out at ambient condition using a CHI electrochemical station. Ag/AgCl and platinum wire were used as reference and counter electrode respectively. The various carbon nanotube electrodes with platinum and other control electrodes were used as working electrode.

Figure 5:
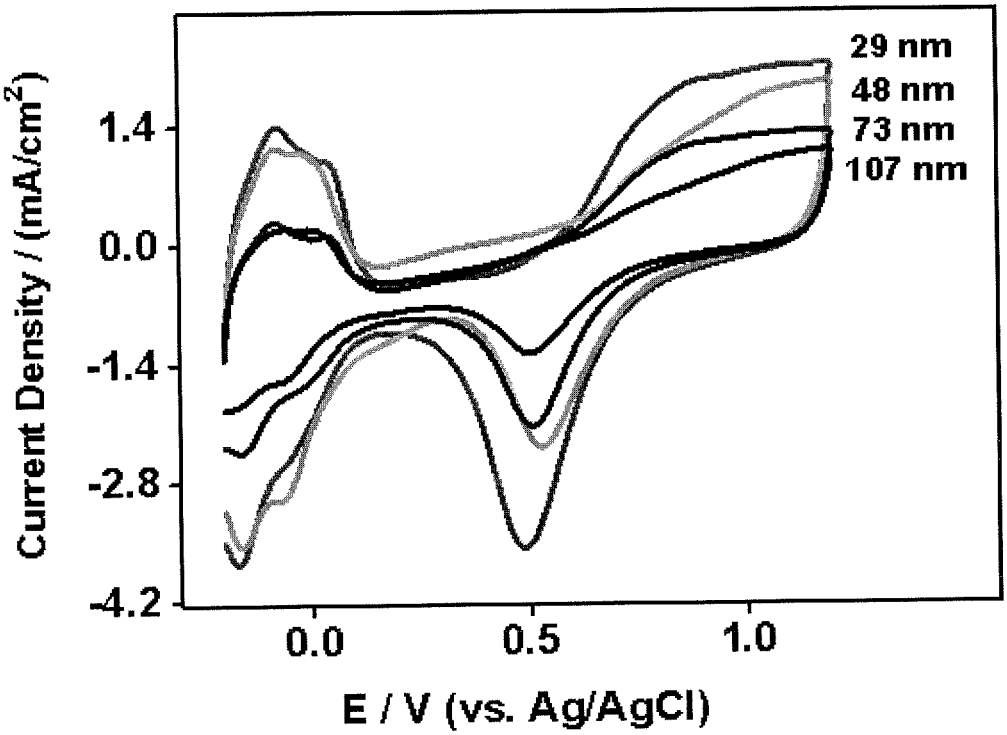
FIG. 5 shows cyclic voltammetry plots of different electrochemical surface area (ECSA) layers for vacuum filtration (VF) fabricated Pt-SWCNT films, according to an embodiment of the invention, made with different sizes of Pt-NPs ranging from 29 nm to 107 nm using cyclic voltammetry in 0.5 M $H_2SO_4$ at a scan rate of 50 mV/s.
Figure 6:
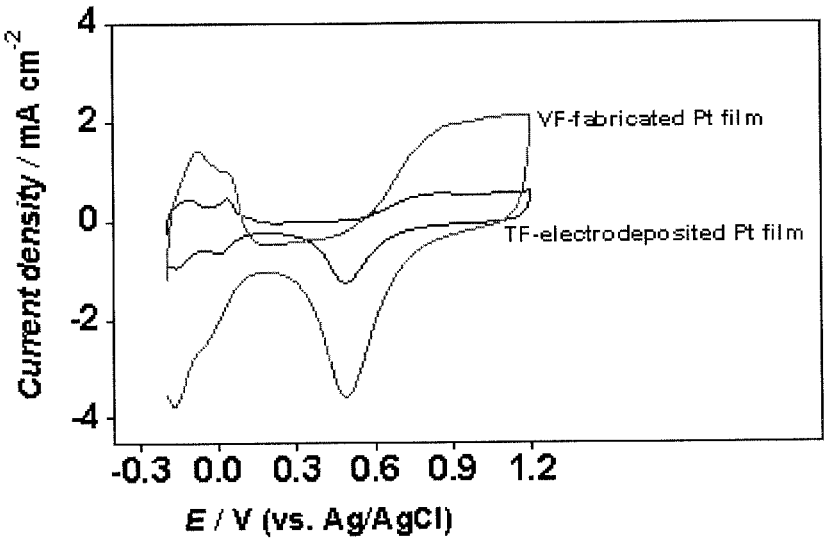
FIG. 6 shows cyclic voltammetry (CV) response plots of a VF-fabricated and a template-free (TF) electrodeposited Pt-SWCNT films, according to an embodiment of the invention, in 0.5 M $H_2SO_4$ at the scan rate of 50 mV $s^{-1}$.

Electrochemical surface areas (ECSAs) of VF fabricated Pt-NP films with different sizes of Pt-NPs were measured to characterize electrocatalytic abilities. Electrochemical CV profiles of the films were obtained in 0.5 M $H_2SO_4$, as shown in FIG. 5, where a distinct Pt oxide reduction peak at potential 0.45 V is observed. ECSA was determined from the charge of the reduction peak of Pt oxide of 210 $\mu Ccm^{-2}$. With a decrease in the Pt-NPs size, ECSA increased gradually, which corresponds with an increase in the catalytic current for smaller particle diameters. The ESCA of VF fabricated Pt films made with about 29 nm Pt-NPs were compared to TF-electrodeposited Pt films on different substrates. The electrochemical surface area is significantly higher, 10-times for VF fabricated 29 nm Pt-SWCNT film over the electrodeposited Pt film on 8.8 $\mu g/cm^2$ SWCNTs loaded on a MCE substrate, as shown in FIG. 6. Combining with the larger current density, peak current ratio, and ECSA of the VF fabricated films demonstrate better performance compared to the electrodeposited Pt thin films on GCE, FTO and commercially available Pt electrodes, as shown in FIG. 1A.

Figure 7A:
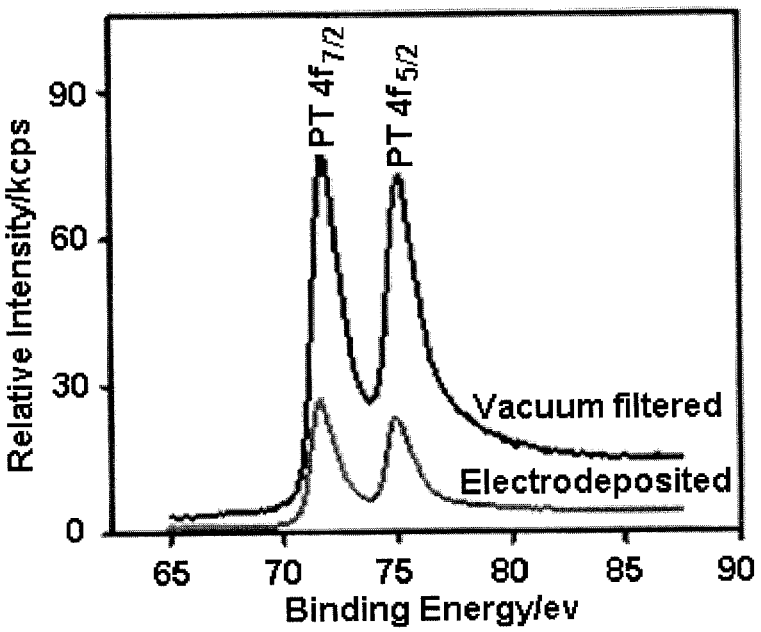
FIG. 7A shows XPS spectra of Pt nanostructures on SWCNT paper by electrodeposition and by VF, according to an embodiment of the invention.
Figure 7B:
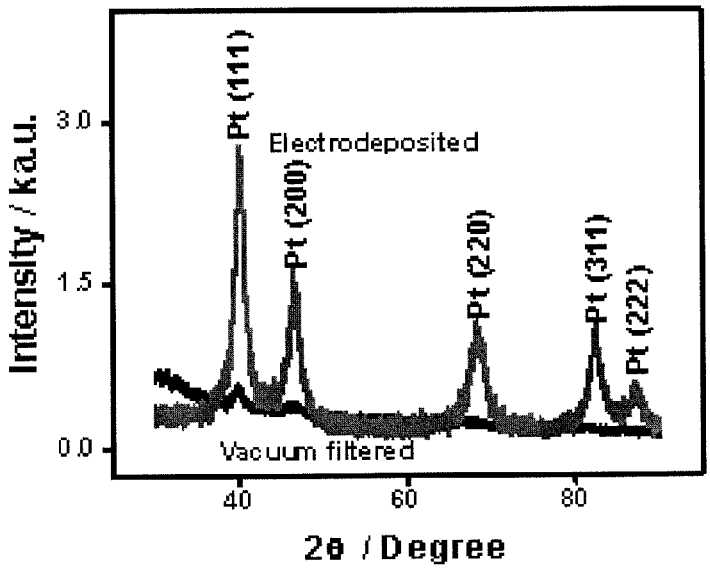
FIG. 7B shows XRD patterns for Pt nanostructures on SWCNT paper by electrodeposition and by VA-LBL, according to an embodiment of the invention.

X-ray Photoelectron Spectroscopy (XPS) was used for speciation of platinum on SWCNT paper. FIG. 7A shows the XPS analysis of the Pt-SWCNT composites showing platinum 4f spectra, confirming the assembly of platinum on the surface of SWCNT paper. The spectra are well-resolved with doublets of $Pt4f_{7/2}$ and $Pt4f_{5/2}$ showing platinum is present in the form of Pt(0) in both samples. ED-fabricated sample shows doublets with binding energies of 71.63 and 74.88 eV whereas VF fabricated sample shows doublets with binding energies of 71.73 and 75.18 eV respectively. The higher intensity of Pt(0) in the surface of VF fabricated sample (2.84×) as compared to ED fabricated sample indicates that higher surface area could be achieved in VF fabricated samples. FIG. 7B shows the XRD pattern of prepared Pt nano-clusters on the surface of SWCNT. Peaks at 2θ=39.8°, 46.12°, 67.52°, 84.9° and 87.04° are assigned to crystalline planes of face centered cubic of Pt (111), Pt (200), Pt (220), Pt (311) and Pt (222), respectively, indicating that platinum exists in crystalline form. The platinum nano-flower prepared by ED showed the presence of well-defined platinum nano-crystals, as indicated by high intensity of planes, on the surface of CNT, which indicates complex nano-flower like structure, is formed by periodic Pt nano-crystals during the electrochemical growth. However, very low intensity in VF fabricated sample shows not a periodic but a random distribution of Pt atoms (Pt nanoparticles) on the surface of CNT.

Figure 8:
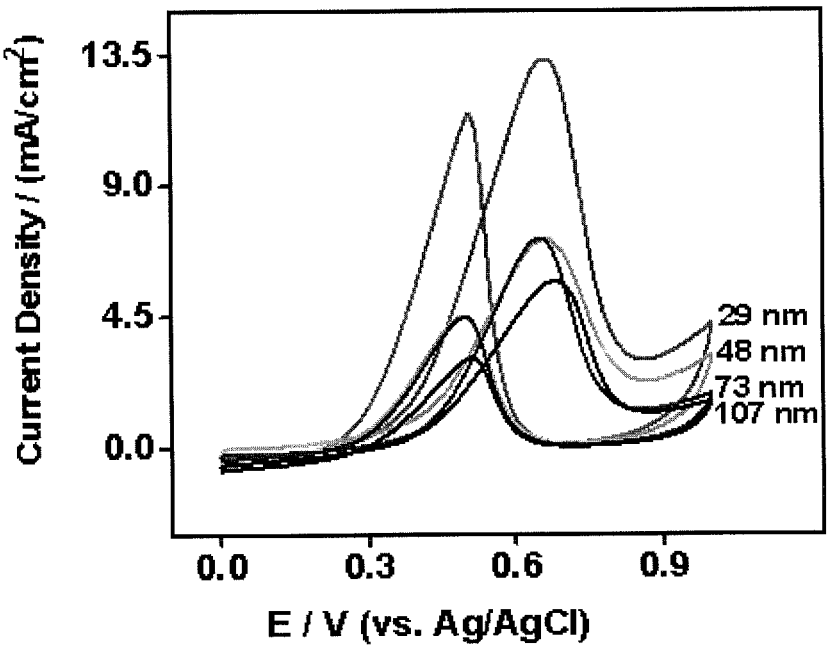
FIG. 8 shows CV response plots of methanol electro-oxidation current densities for Pt-NP layers on 8.8 μg/$cm^2$ of SWCNTs loaded MCE substrate, according to an embodiment of the invention, with Pt-NPs sizes of 29, 48, 73, and 107 nm at room temperature in 0.1 mol/L methanol in 0.1 mol/L $H_2SO_4$ over the potential range of 0 to 1.0 V with a scan rate of 50 mV $s^{-1}$.
Figure 9A:
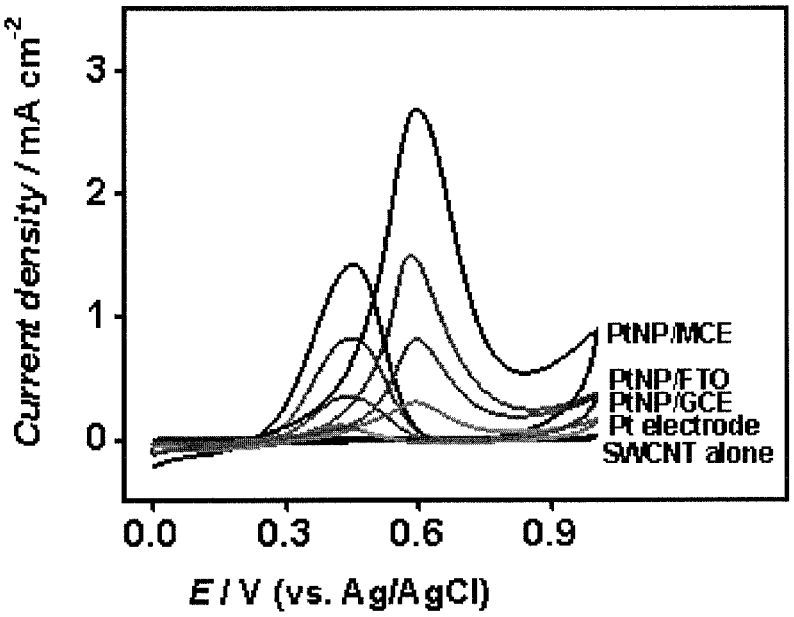
FIG. 9A shows CV response plots for the activity of electro-oxidation of methanol on an electrodeposited Pt film on a glassy carbon electrode (GCE), on a fluorine doped tin oxide (FTO) electrode, and on a 8.8 μg/$cm^2$ SWCNT deposited MCE substrate, and with the controls of a commercial Pt electrode and a film of 8.8 μg/$cm^2$ SWCNT deposited on an MCE substrate, with scans at room temperature in 0.1 M methanol and 0.1 M $H_2SO_4$ in the potential range of 0 to 1.0 V with a scan rate of 50 mV/s.
Figure 9B:
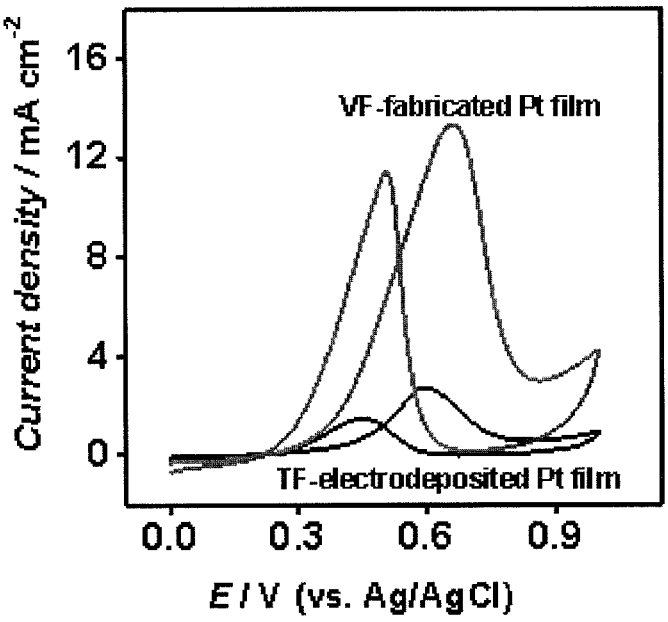
FIG. 9B shows methanol electro-oxidation activity plots for: A) a Pt-SWCNT (~29 nm) layer by vacuum filtration, according to an embodiment of the invention, and a Pt-SWCNT layer by TF-electrodeposition for films of 100 μg of SWCNTs.

Cyclic voltammogram for methanol electro-oxidation activity was measured to characterize the VF fabricated Pt films with different sizes of Pt-NPs in a three-electrode cell using a CHI 760D electrochemical workstation. Saturated Ag/AgCl solution, a Pt wire and the Pt-SWCNT films were used as the reference, counter, and working electrodes, respectively. Two oxidation peaks for methanol were observed at 0.65 (forward peak current, $i_f$) and 0.45V (backward peak current, $i_b$) as shown in FIG. 8, corresponding to the oxidation of methanol and intermediates produced during the methanol oxidation, respectively. The size of the Pt-NPs intrinsically affects the catalytic behavior of the film. Increase in the particle size can result in an increased thickness of the Pt-NPs, which can decrease the current density of both the anodic peaks. The ratio of $i_f$ to $i_b$ can serve as a fingerprint to evaluate the electrode efficiency, i.e., its tolerance to catalyst poisoning. The larger the ratio, the greater the proportion of the methanol oxidized and the smaller the proportion of incompletely oxidized (C—O) species that accumulate on the surface of electrodes. Though the current density decreased from 13.5 mA $cm^{-2}$ (29 nm Pt-NPs) to 7.2 mA $cm^{-2}$ (48 nm Pt-NPs) as the size of the Pt-NPs increased, the $i_f/i_b$ ratio increased from 1.15 to 1.61. Further increases in the size of the Pt-NPs to more than 48 nm, increased the $i_f/i_b$ ratio to 1.83 while the current density deceased to 5.5 mA·$cm^{-2}$ (107 nm Pt-NPs). Among the VF fabricated films, 29 nm particle size films show higher current density and ECSA, as addressed below; however, the peak current ratio showed little difference to films with larger nanoparticles. Cyclic voltammogram for methanol oxidation in 0.1M $H_2SO_4$ containing 0.1M methanol at the scan rate of 50 mV $s^{-1}$ are shown in FIG. 9A. Except for the SWCNT electrode, all the electrodes showed characteristic methanol oxidation peak with forward peak potential at ~0.65V and backward peak potential at ~0.44V. No methanol peak in the absence of Pt shows that SWCNT has no direct role on oxidation of methanol. Higher current densities (3.4 $mAcm^{-2}$ and 7.2 $mAcm^{-2}$) of Pt nanostructures on both ED and Vf fabricated samples show that SWCNT paper is good supporting material for the Pt catalyst. Higher concentrations of methanol (0.5M or higher) are used to demonstrate the electrochemical activity of Pt nanostructures for methanol oxidation. In contrast, good electro-catalytic response of Pt nanostructures on SWCNT paper occurs even at low concentration (0.1M) of methanol. With equivalent loading of Pt (0.074 mg/$cm^2$), the VF fabricated sample showed significantly higher (~2.1×) forward peak current density over the ED sample, as shown in FIG. 9B. Higher electro-catalytic response is attributed to the higher ECSA of VF fabricated sample due to 3D nano-porous structure. It is believed that Pt(0) is the active site for the oxidation of methanol. Therefore, the presence of higher percentage of Pt(0) on Vf relative to ED fabricated samples can lead to higher electro-catalytic response.

The oxidation peak in the reverse scan is due to oxidative removal of carbon species formed in the forward scan. Therefore, the ratio of forward peak current to backward peak current is an indicator of tolerance to CO poisoning of an electrode. The higher ratio in both samples (1.65 for VF and 1.60 for ED) indicates better CO tolerance than commercially available E-TEK catalyst (0.74). This results from the porous structure of the SWCNT support where oxidative carbon species are easily removed from the surface of the electrode, before undergoing electrochemical oxidation. Mass specific activities of Pt nanostructures on SWCNT paper are found to be 45.94 mA/mg and 97 mA/mg for ED and VF fabricated samples, respectively.

VF fabricated 29 nm Pt film, when compared to electrodeposited thin Pt films on different substrates shows a peak current density ($i_p$) of the vacuum filtration fabricated Pt film at Ep=0.65 V of 13.5 mA/$cm^2$, which is about 5 times greater than that for the electrodeposited Pt-SWCNT electrode (2.7 mA·$cm^{-2}$), as shown in FIG. 6. The higher electrocatalytic activity of VF fabricated Pt-SWCNT film may be the result of a unique three-dimensional nanostructure of smaller Pt-NPs size deposited with high dispersion on the SWCNT/MCE substrate having a higher effective number of catalytic sites. When compared with an electrodeposited Pt film formed on a commercial Pt electrode, glassy carbon electrode, or fluorine doped tin oxide electrode, a greater electrocatalytic current is observed on SWCNT deposited MCE substrate, as shown in FIG. 1A, due to the larger effective surface area of the vacuum filtration fabricated Pt-SWCNT film.

All patents, patent applications, provisional applications, and publications referred to or cited herein are incorporated by reference in their entirety, including all figures and tables, to the extent they are not inconsistent with the explicit teachings of this specification.

It should be understood that the embodiments described herein are for illustrative purposes only and that various modifications or changes in light thereof will be suggested to persons skilled in the art and are to be included within the spirit and purview of this application.

We claim:

1. A porous conductive thin film, comprising a filter medium support, at least one first layer comprising a plurality of conductive carbon nanomaterials with an aspect ratio in excess of 100, and at least one second layer consisting of a continuous network of spherical or rod shaped metal nanoparticles having an aspect ratio of 1.4 to 18 and 2 nm to 100 nm in size.

2. The porous conductive thin film according to claim 1, wherein the conductive carbon nanomaterials comprise graphene flakes, multi-walled carbon nanotubes, metallic or semi-metallic single-walled carbon nanotubes, or any mixture thereof.

3. The porous conductive thin film according to claim 1, wherein the metal nanoparticles are amorphous metal nanoparticles.

4. The porous conductive thin film according to claim 1, wherein the metal nanoparticles comprise gold, silver, copper, platinum, palladium, any alloy thereof, or mixtures thereof.

5. The porous conductive thin film according to claim 1, wherein the filter medium is a MCE, PVDF, PES PTFE, polycarbonate, or cellulose filter.

6. The porous conductive thin film according to claim 1, comprising a multiplicity of layers wherein the layers of conductive carbon nanomaterials alternate with layers of metal nanoparticles.

7. The porous conductive thin film according to claim 6, wherein the layers of metal nanoparticles comprise different metals.

8. The porous conductive thin film according to claim 1, wherein the metal nanoparticles are about 2 to about 100 nm in diameter.

9. The porous conductive thin film according to claim 1, wherein the metal nanoparticles are spherical or rod-like.

10. A method of forming a porous conductive thin film according to claim 1, comprising:

providing a filter medium support;

providing a first aqueous dispersion of conductive carbon nanomaterials;

providing a first aqueous dispersion of spherical or rod shaped metal nanoparticles having an aspect ratio of 1.4 to 18 and 2 nm to 100 nm in size;

filtering the first aqueous dispersion of the conductive carbon nanomaterials through the filter medium support to form a first layer of conductive carbon nanomaterials; and filtering the first aqueous dispersion of the metal nanoparticles through the first layer of conductive carbon nanomaterials and the filter medium support to form a second layer comprising metal nanoparticles.

11. The method according to claim 10, further comprising filtering a second aqueous dispersion of the conductive carbon nanomaterials through the second layer of metal nanoparticles and the filter medium support to form a third layer of conductive carbon nanomaterials and filtering a second aqueous dispersion of the metal nanoparticles through the third layer of conductive carbon nanoparticles, the second layer of metal nanoparticles and the filter medium support to form a fourth layer of metal particles.

12. The method according to claim 10, further comprising alternating steps of filtering an n-th aqueous dispersion of conductive carbon nanomaterials and an m-th aqueous dispersion of metal nanoparticles to form a (2n−1) th layer of conductive carbon nanomaterials alternating with a 2m th layer of metal nanoparticles, wherein n is 3 to 10.

13. The method according to claim 10, wherein the conductive carbon nanomaterials are metallic or semi-metallic single-walled carbon nanotubes and the metal nanoparticles are gold nanoparticles or platinum nanoparticles.

14. The method according to claim 10, wherein the dispersion of the metal nanoparticles is a citrate stabilized gold nanoparticle dispersion.

15. An electronic device, comprising a porous conductive thin film according to claim 1.

16. The electronic device according to claim 15, wherein the porous conductive thin film is an electrode.

17. The electronic device according to claim 15, wherein the porous conductive thin film is a structure in a detector, a transistor, or a photovoltaic device.

* * * * *